United States Patent [19]

Reiner

[11] 4,303,011

[45] Dec. 1, 1981

[54] AUTOMATIC PLATEN PRESS

[76] Inventor: Ralph E. Reiner, R.D. 2 Chestnut Ridge Rd., Orchard Park, N.Y. 14127

[21] Appl. No.: 195,500

[22] Filed: Oct. 9, 1980

Related U.S. Application Data

[63] Continuation of Ser. No. 36,062, May 4, 1979, abandoned.

[51] Int. Cl.[3] ..... B30B 9/06

[52] U.S. Cl. ..... 100/122; 100/123; 100/208

[58] Field of Search ..... 100/122, 123, 110, 116, 100/124, 126, 198, 208, 224, 264

[56] References Cited

U.S. PATENT DOCUMENTS

| | | | |
|---|---|---|---|
| 729,807 | 6/1903 | Storeken | 100/123 X |
| 1,131,032 | 3/1915 | Berrigan | 100/123 X |
| 2,552,171 | 5/1951 | Hagerty | 100/208 X |
| 3,541,951 | 11/1970 | Lienhard | 100/116 X |
| 3,592,127 | 7/1971 | Cooley | 100/122 |
| 4,191,103 | 3/1980 | Wettlaufer | 100/123 X |
| 4,201,672 | 5/1980 | Kenyon | 210/225 |
| 4,209,404 | 6/1980 | Yoshida | 210/225 |

FOREIGN PATENT DOCUMENTS

| | | |
|---|---|---|
| 18584 | of 1913 | United Kingdom . |
| 14976 | of 1915 | United Kingdom . |
| 8430 | 7/1916 | United Kingdom . |
| 4314440 | 7/1935 | United Kingdom . |

*Primary Examiner*—Edward J. McCarthy

*Attorney, Agent, or Firm*—Bean, Kauffman & Bean

[57] ABSTRACT

A press particularly adapted for use in extracting juice from fruit, such as apples, features a vertically extending sleeve of filter cloth disposed intermediate a pair of cooperating press platens supported for movement horizontally relative to one another for squeezing fruit contained within the sleeve. An open upper end of the sleeve is arranged in communication with a hopper or the like providing for batch-wise charging of the sleeve with fruit to be pressed and a valve mechanism is employed to selectively clamp off or close a normally open lower end of the sleeve in order to alternatively retain a charge of fruit within the sleeve during a pressing operation and permit discharge of pressed fruit pulp in the form of a "cake" from which juice has been extracted.

18 Claims, 11 Drawing Figures

16c'
20'
60'
50'
52'
26'
18
26
50
20
56a
16c
58a'
58b'
78
34
52
60
58a
74a
58b
56a'
36
146'
146
26'
26
112b'
110'
110
44
112b
28
114b
40'
42'
40
54'
42
54
146
44
26
110
112b
52'
20
50'
52
56a'
34
50
56a
60'
66'
66
60
16c'
70
32
78
58a
74
70
16c
68'
62'
64'
68
62
72
64
58b
68
32
20
16d
16d
22
90a'
90a
84'
96'
96
84
86b'
46
86b
24'
46'
24
92
30'
92'
94
30
94'
90
98'
90'
98
16h'
88'
88
16h
104'
104
104
100
16f
80b'
100'
28b'
48
102
86b
28b
102'
14

AUTOMATIC PLATEN PRESS

CROSS REFERENCE TO RELATED APPLICATION

This application is a continuation of application Ser. No. 36,062, filed May 4, 1979, abandoned.

BACKGROUND OF THE INVENTION

For many years, platen presses operated by manually actuated screw jacks and more recently by hydraulic cylinder devices, have been employed to extract juice from fruit, such as apples. These presses conventionally include horizontally disposed upper and lower platens, which are permanently supported in the press for vertically directed relative movements and, if desired, one or more additional platen-like elements, which may be removably positioned in the press in order to permit a plurality of layers of fruit to be pressed at the same time. The fruit to be pressed is preferably cut in small pieces and arranged to assume a relatively thin layer between each pair of adjacent platens; a sheet of filter cloth, such as "cheesecloth", being folded to define a "bag" enclosing the fruit in each layer. Characteristic of this type of press is the slow application of pressure to thin layers of fruit, which allows for maximum percentage extraction of juices, while permitting pieces of fruit to serve as filtering medium resulting in the production of high quality juice, i.e., a minimum pulp content, which may be marketed without the need for performing subsequent filtering or clarification operations. However, conventional platen press units are labor intensive and have a low output capacity, due to the time involved in charging the press with fruit and removing therefrom the layer(s) of compressed pulp or "cake" remaining after the juice has been extracted.

Commercial juice extraction operations have placed in use various types of automatic, large capacity presses, but with varying degrees of success. In this respect, it has been found that those types of automatic press units, which are most efficient from the standpoint of achieving maximum juice extraction tend to suffer from the drawback that the juice is normally of lower quality, i.e., has an unacceptably large pulp content, and this necessitates the utilization of expensive juice filtration or clarifying equipment/procedures. Other types of commercially available automatic press units are capable of producing high quality juice, but appear to universally suffer from the drawback that only a portion of available juice is actually extracted from the pulp. Thus, economic considerations require that the pulp from this latter type of press unit be subjected to a "second-time" press operation in basic platen press units of the type described above.

Further, it has been recognized that the drawbacks of both basic platen press units and automatic large capacity press units would be avoided, if some means were found to automate the platen press unit so as to increase its output capacity and avoid the necessity of using workers to load and unload the press unit, without sacrificing its maximum efficiency output of high quality juice.

SUMMARY OF THE INVENTION

The present invention is directed towards an improved press construction providing for automatic loading and unloading of a platen press without sacrificing the maximum efficiency of output of high quality juice characteristic of a conventional platen press unit.

A press formed in accordance with the present invention features the utilization of a vertically extending sleeve of filter cloth, which has normally open upper and lower ends and is arranged between a cooperating pair of vertically disposed platens supported for relative converging horizontal movements to effect squeezing or compressing of fruit contained within the sleeve. More specifically, the upper end of the sleeve is arranged in communication with a hopper or the like providing for batchwise charging of the sleeve with fruit to be pressed and a valve mechanism is employed to selectively clamp off or close the lower end of the sleeve in order to alternatively retain a charge of fruit within the sleeve, during convergent movements of the platens, and permit discharge of pressed fruit pulp in the form of a "cake" from which juice has been extracted.

In a preferred construction, the valve mechanism is defined by a clamping surface defined by a stationary juice collecting trough arranged in association with a stationary one of the pair of platens and a clamping surface defined by a movable juice receiving trough arranged for association with a movable one of the platens. A doubling of the output of the present press construction may be achieved by employing a pair of sleeves arranged intermediate the stationary platen and a pair of movable platens.

DRAWINGS

The nature and mode of operation of the present invention will now be more fully described in the following detailed description taken with the accompanying drawings wherein:

FIG. 3 is a front elevational view of the press;

FIG. 4 is a sectional view taken generally along the line 4—4 in FIG. 3;

Figures 1, 2:
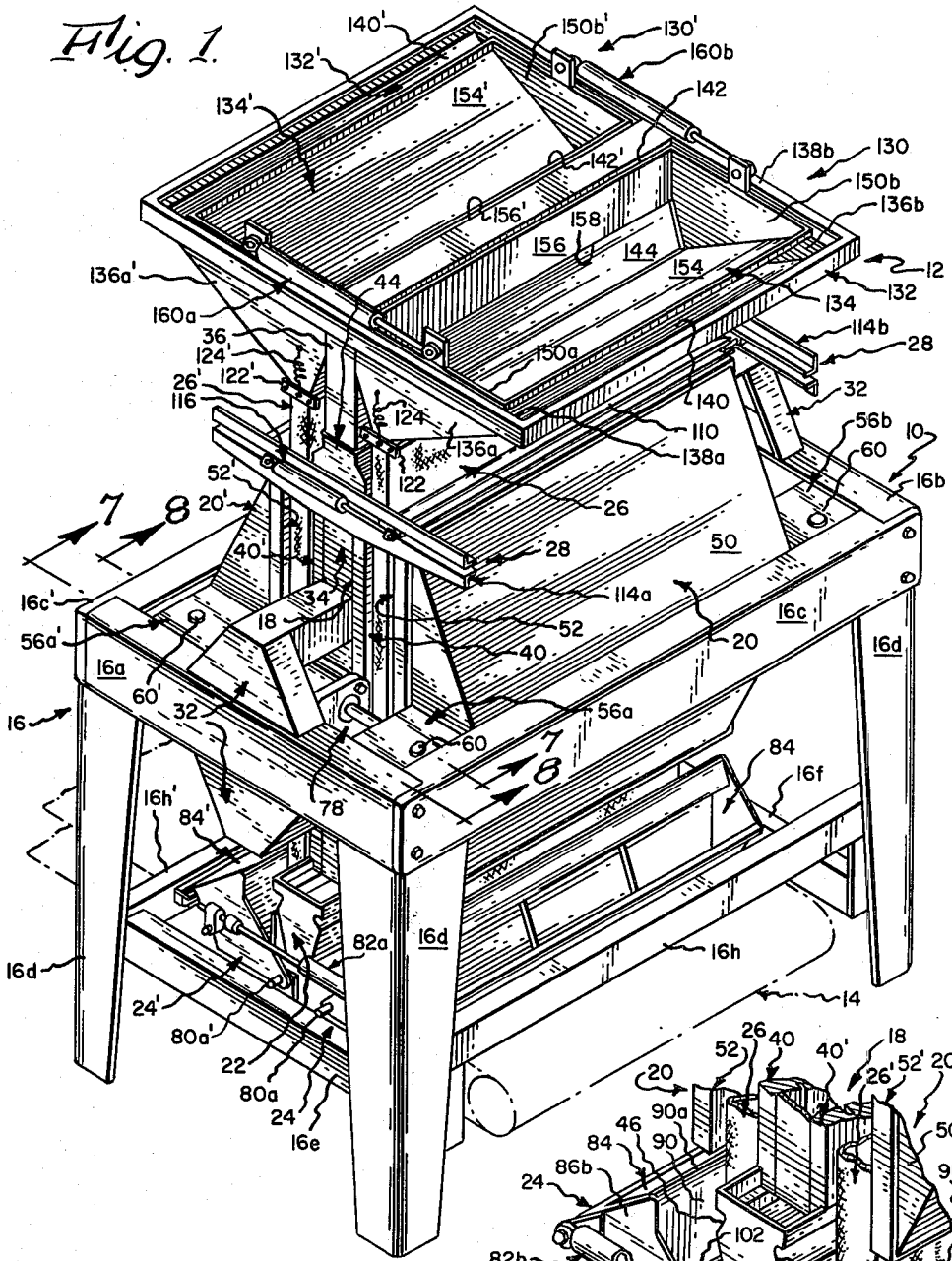
FIG. 1 is a perspective view of a press of the present invention.
FIG. 2 is a fragmentary perspective view of the press as seen from the rear.
Figure 6:
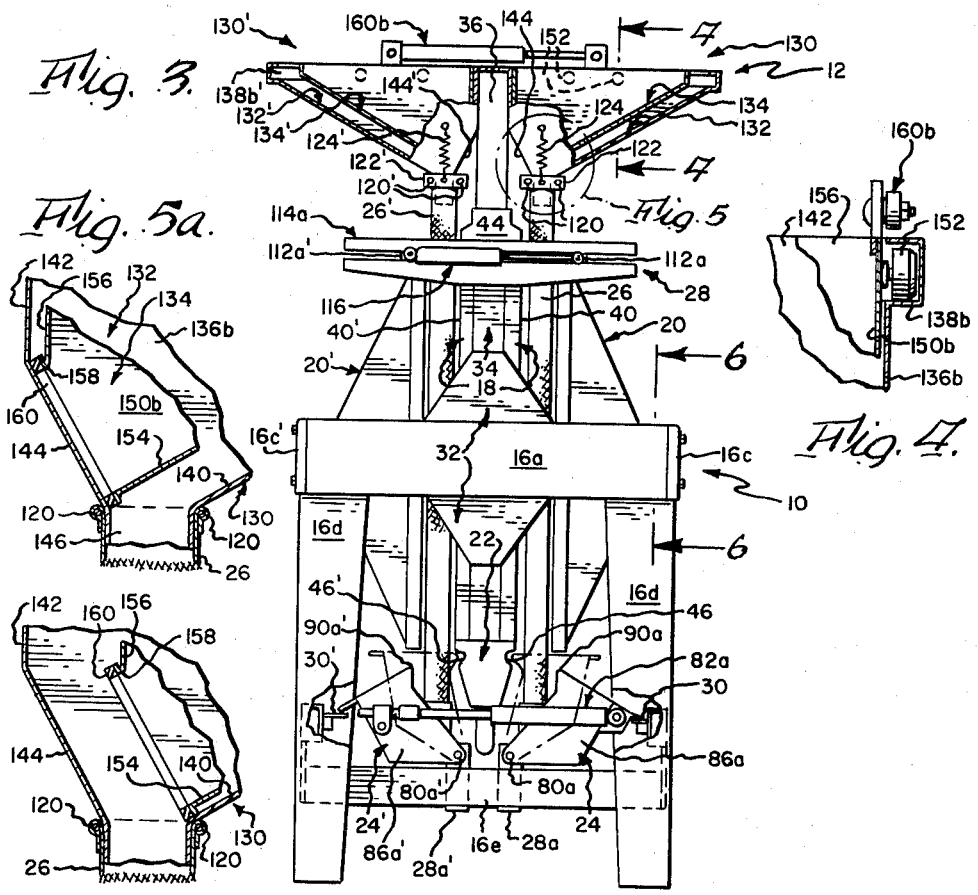
Figures 7, 8, 10:
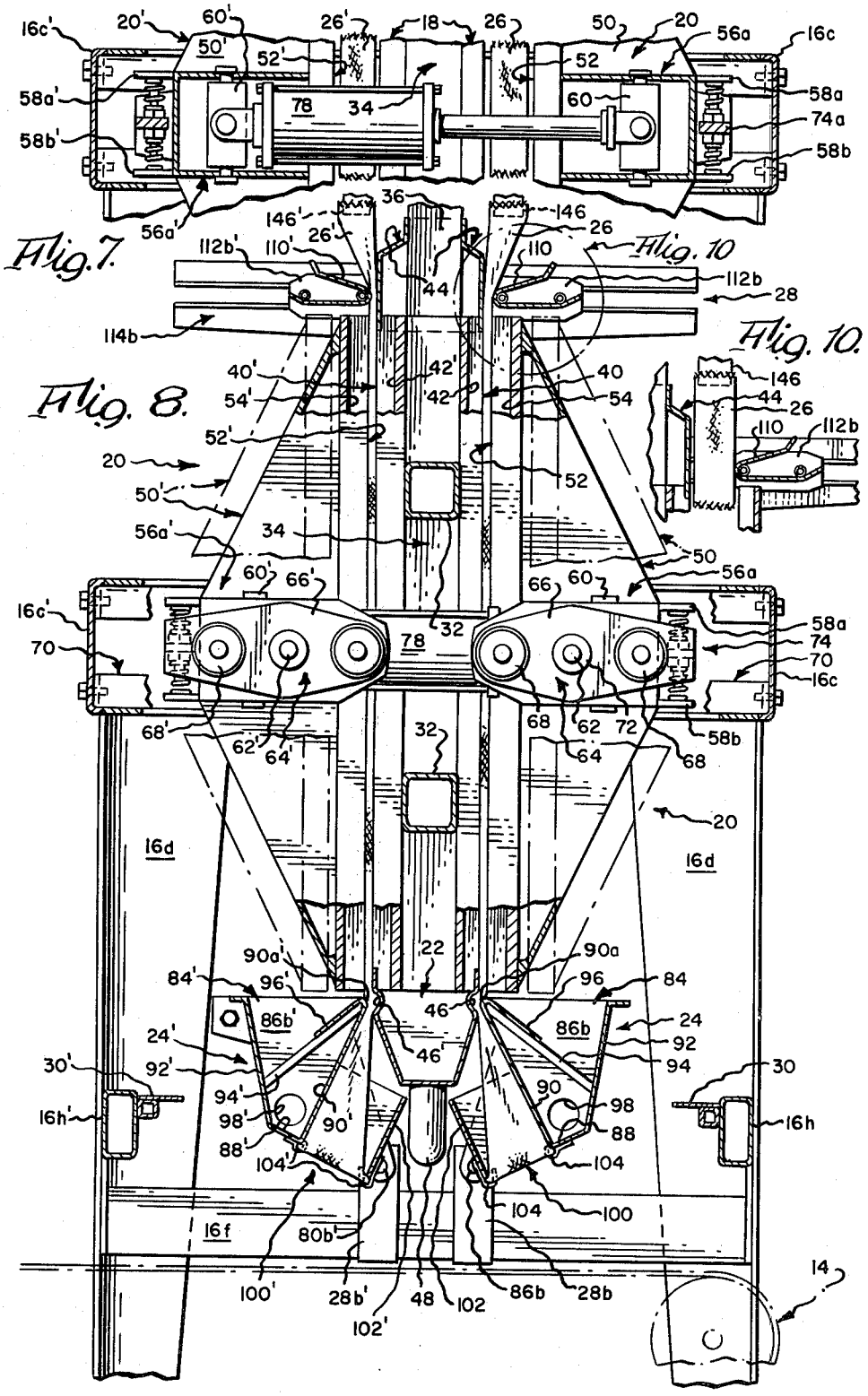

FIGS. 5*a* and 5*b* are fragmentary enlarged views of the area designated as FIG. 5 in FIG. 3 with parts broken away for purposes of clarity;

FIG. 6 is a sectional view taken generally along line 6—6 in FIG. 3;

FIG. 7 is a sectional view taken generally along line 7—7 in FIG. 1;

FIG. 8 is a sectional view taken generally along line 8—8 in FIG. 1;

FIG. 9 is an exploded perspective view showing a portion of the upper valve assembly; and FIG. 10 is a view of the area designated as FIG. 10 in FIG. 8 with parts shown in press open position.

DETAILED DESCRIPTION

Reference is first made to FIG. 1, wherein a press formed in accordance with the present invention is generally designated as 10 and shown in association with a fruit supply mechanism 12 and a pressed fruit pulp or "cake" discharge conveyor 14.

Press 10 preferably includes a main framework 16; a stationary, double faced platen device 18; first and second movable, single faced platen devices 20 and 20'; a stationary juice collection trough device 22 arranged in association with platen device 18; first and second movable juice collection trough devices 24 and 24', which are arranged in association with platen devices 20 and 20', respectively; a pair of vertically extending, open ended sleeves 26 and 26', which are of generally rectangular cross-sectional design and fabricated from a suitable filter cloth, such as "cheesecloth"; and an upper valve plate mechanism 28.

Framework 16 is shown as including a rectangular top frame portion defined by front, rear and opposite side channel irons 16*a*, 16*b*, 16*c* and 16*c'*, respectively, which are end joined and arranged in an inwardly facing relationship; angle iron leg or pedestal corner supports 16*d*; and front, rear and opposite side channel iron corner support braces 16*e*, 16*f*, 16*h* and 16*h'*, respectively. It will be understood by reference to FIGS. 3 and 8 that front and rear braces 16*c* and 16*f* serve to mount brackets 28*a*, 28*a'* and 28*b*, 28*b'*, which serve to support trough devices 24 and 24' for movement between their retracted cake discharge and operative/-pressing positions shown in full and broken line in FIG. 8; and that side braces 16*h* and 16*h'* serve to mount stop brackets 30 and 30', which are arranged to be engaged by trough devices 24 and 24' in order to define their retracted positions. Also, it will be understood by reference to FIGS. 1, 3 and 8 that front and rear channel irons 16*a* and 16*b* serve to mount pairs of generally L-shaped flanges 32, which have their facing inner ends fixed to front and rear ends of a support assembly 34. Assembly 34, which includes front and rear support posts 36 serves to mount stationary platen device 18, stationary trough device 22, upper valve plate mechanism 28 and hopper device 12.

Stationary platen device 18 includes a pair of vertically extending parallel and oppositely facing platen elements 40 and 40', which are of rectangular configuration when viewed in elevation and formed with parallel vertically extending slot recesses 42 and 42' having their lower ends disposed in flow communication with trough device 22. The upper ends of slot recesses 42 and 42' are closed by a closure or cover device 44.

By viewing FIGS. 2, 3 and 8, it will be understood that trough device 22 has a generally U-shaped configuration and is characterized in that its vertically extending side wall portions are shaped to define oppositely facing and lengthwise extending clamping recesses 46 and 46' and in that its rear end is fitted with a drain fixture 48 adapted to be connected to a suitable juice storage device, not shown.

In that first and second platen devices 20 and 20' are of mirror image construction, only platen device 20 will be described in detail with like primed numbers being used to designate like parts of platen device 20'. Platen device 20 generally includes a support assembly 50 for mounting a platen element 52, which has a rectangular configuration and is formed with a plurality of parallel vertically extending slot recesses 54. As will be apparent from the drawings, assembly 50 serves to support platen element 52 to assume an essentially parallel and facing relationship relative to platen element 40 and to move or reciprocate horizontally between the remote changing and adjacent pressing positions shown in broken and full line, respectively, in FIG. 8.

Assembly 50 includes a central platen support portion and identically constructed front and rear mounting assemblies 56*a* and 56*b*. Each of mounting assemblies 56*a* and 56*b* includes a box-shaped weldment having an open end facing in the direction of second platen device 20'; an opposite end plate fitted with parallel upper and lower adjustment flanges 58*a* and 58*b*; upper and lower plates formed with aligned apertures to receive a pivot pin 60; and an outwardly facing side plate carrying a pivot pin 62. Each of the mounting assemblies is operably associated with a carrier assembly 64 shown in FIGS. 6 and 8 as including a carrier plate 66 fitted with a pair of rollers 68 sized for receipt within a guide channel 70 extending lengthwise of front channel iron 16*a*; a bearing or bushing 72 for journaling pivot pin 62; and an adjustment mechanism 74 adapted for use in effecting pivotal movements of platen device 20 about the axis of pivot pins 62 as required to position platen element 52 parallel to or at some other desired orientation relative to platen element 40. Mechanism 74 comprises an intermediate flange 74*a* carried by carrier plate 66 and disposed vertically intermediate adjustment flanges 58*a* and 58*b*; a threaded rod 74*b* carried by intermediate flange 74*a*; a pair of rod mounted adjustment nuts 74*c*, 74*c*; and a pair of coil springs 74*d*, 74*d* arranged concentrically of rod 74*b* for end bearing engagement with nuts 74*c*, 74*c* and adjustment flanges 58*a* and 58*b*.

It will be understood that first and second platen devices 20 and 20' are coupled together for simultaneous movement towards and away from platen device 18 between their charging and pressing positions by front and rear piston-cylinder devices 78 of like construction. The front piston-cylinder device is shown in FIGS. 1, 7 and 8 as being disposed to extend lengthwise adjacent framework front channel iron 16*a* and as having its opposite ends pivotally coupled or connected to pivot pins 60 and 60'.

Now making reference to FIGS. 2, 3 and 8, it will be noted that first and second trough devices 24 and 24' are pivotally connected to brackets 28*a*, 28*b* and 28*a'*, 28*b'*, by aligned pivot pins 80*a*, 80*b* and 80*a'*, 80*b'* for movements between their above described retracted/cake discharge and operative/pressing positions under the control of front and rear piston-cylinder devices 82*a* and 82*b*.

In that trough devices 24 and 24' are of mirror image construction, only device 24 will be described in detail with like parts of trough device 24' being designated by like primed numbers. Device 24 generally includes a trough portion 84 bounded by parallel front and rear closure/mounting plates 86*a* and 86*b*, a bottom plate 88, upwardly diverging inner and outer plates 90 and 92 reinforced or braced by rods 94, a reinforcing splash plate 96, joined to the upper edge of inner plate 90 and arranged to extend downwardly within the trough portion; a drain fixture 98 adapted to connect trough portion 84 with a suitable juice storage device, not shown; and a cake discharge chute portion 100 bounded by a generally U-shaped bracket 102 having its free ends fixed as by welding to inner plate 90. By referring to FIG. 8, it will be understood that the upper edge 90*a* of inner plate 90 is arranged and contoured for receipt within clamping recess 46 when trough device 24 is arranged in its operative or pressing position, and that chute portion 100 is sized to receive the lower end of sleeve 26 and fitted with a lower quick disconnect mounting mechanism, such as may be defined by a pair of spring clip mounted rods 104, which serves to removably mount the lower end of sleeve 26, such that the latter is maintained in an open condition and generally assumes the rectangular cross-sectional configuration of the chute portion. It will also be understood that trough device 24 is constructed, such that the lower end portion of sleeve 26 is relaxed incident to upward swinging movements of the trough device by an amount sufficient to prevent excessive tensioning of the sleeve as a result of its being clamped between upper edge 90*a* and clamping recess 46.

Upper valve plate mechanism 28 is best shown in FIGS. 1 and 8–10 as including first and second generally V-shaped valve plates 110 and 110', which have their front and rear ends suitably mounted on slide blocks 112*a*, 112*b* and 112*a'*, 112*b'*. The slide blocks are in turn slidably supported for horizontal reciprocating movements by front and rear guide support devices 114*a* and 114*b* mounted on assembly 34. Front and rear piston-cylinder devices 116, of which only the front device is depicted in the drawings, have their opposite ends coupled to the front and rear slide blocks, respectively, for the purpose of effecting conjunctive movements of valve plates 110 and 110' between their remote/press fill positions indicated in FIGS. 3 and 10 and relatively adjacent clamping positions shown in FIG. 8; the valve plates when in their latter position cooperating with the oppositely facing clamping surfaces of closure 44 to clamp off sleeves 26 and 26' at a point immediately above platen devices 18, 20 and 20'.

As is the case with the lower ends of sleeves 26 and 26', their upper ends are maintained open and to assume a generally rectangular configuration by an upper quick disconnect mounting mechanism shown generally in FIGS. 1, 3, 5*a* and 5*b* as including pairs of rods 120 and 120' having their ends fixed to pairs of end plates 122 and 122'. Preferably, spring devices 124 and 124' are employed to suspend the mounting mechanism from supply mechanism 12 in order to permit slight vertical movements of the upper ends of the sleeves, as required to prevent excessive tensioning of the sleeves incident to clamping thereof between valve plates 110, 110' and the clamping surfaces of closure 44 in the manner described above.

As will be apparent from the drawings, when press 10 is in an open or inoperative condition, the above described upper sleeve mounting mechanism serves to suspend sleeves 26 and 26' and cooperates with the lower sleeve mounting mechanism to maintain the sleeves in an expanded condition, wherein they assume a relatively uniform, generally rectangular cross-sectional configuration throughout their vertical extents. When in their expanded condition, the sleeves would have a thickness, as measured normal to the platen elements, determined by known juice extraction considerations, and a width corresponding to or slightly less than the width or horizontal dimension of the faces of such platen elements.

Supply mechanism 12 is shown as including a pair of hopper mechanisms 130 and 130'. In that these mechanisms are of mirror image construction, only mechanism 130 will be specifically described as generally comprising an upwardly open hopper receiver 132 and an upwardly open measuring hopper 134. Hopper receiver 132 is defined by parallel front and rear plates 136*a* and 136*b* having channels 138*a* and 138*b* fixed to their upper marginal edges; a downwardly and inwardly inclined outer plate 140; a composite inner plate having upper and lower portions 142 and 144; and a rectangular discharge duct or fixture 146, which is joined to the lower marginal edges of plates 136*a*, 136*b*, 140 and 144 to define a discharge opening or outlet for hopper receiver 132. Duct 146 is transversely sized to freely slidably receive the open upper end of sleeve 26 and provided with a length permitting relatively vertical movements, without separation, of the upper end of sleeve 26. Measuring hopper 134 is defined by front and rear plates 150*a* and 150*b*, which are disposed parallel to front and rear plates 136*a* and 136*b* and serve to mount guide rollers 152 arranged for receipt within guide channels 138*a* and 138*b*; a downwardly and inwardly inclined outer plate 154 disposed parallel to outer plate 140; and an inner plate 156 disposed parallel to inner plate upper portion 142. As will be apparent from FIGS. 5*a* and 5*b*, plates 150*a*, 150*b*, 154 and 156 cooperate to define a generally rectangular discharge opening 158 bounded by a sealing device 160 arranged to removably sealingly engage with inner plate lower portion 144.

As will be apparent, measuring hoppers 134 and 134' are supported within hopper receivers 132 and 132' by rollers 152 and 152' to undergo reciprocating movements between their measuring or charge receiving and discharge positions shown in FIGS. 5*a* and 5*b*, respectively, under the control of front and rear piston-cylinder devices 160*a* and 160*b*. The volume of each charge of fruit to be pressed may be determined by fitting measuring hoppers 134 and 134' with suitable level measuring devices, such as may be defined by floats or electric eye devices, not shown, which would serve to control feeding of fruit to such hoppers. Alternatively, charges of fruit to be pressed may be formed and measured at a remote point and subsequently conveyed to the measuring hoppers in a desired timed relationship, as determined by the operational speed of press 10.

Discharge conveyor 14 is illustrated in the drawings solely to indicate one suitable arrangement adapted for use in removing pulp or "cake" discharge from the press at the completion of the juice extraction operation. However, conveyor 14 forms no part of the present invention.

Operation of press 10 will now be described by first making reference to FIG. 3, wherein the elements of the press are indicated as being in a "start-up" or non-operating condition. In this condition cylinder devices 160*a* and 160*b* are contracted in order to place measuring hoppers 134 and 134' in their measuring positions, wherein their discharge openings are closed off and sealed relative to lower plate portion 144 and 144'. Further, in this condition, piston-cylinder devices 78; 82*a*, 82*b*; and 116 are in their extended conditions allowing sleeves 26 and 26' to simply "hang" from mechanism 12 and assume an open, rectangular cross-sectional configuration throughout their vertical extents.

Operation of press 10 is commenced by placing fruit within hoppers 134 and 134' to create charges of fruit having volumes corresponding essentially to or slightly less than the volumes of those portions of sleeves 26 and 26' vertically coextensive with platen elements 42, 42', 52 and 52'. Prior to discharge of the charges of fruit by extension of piston-cylinder devices 160*a* and 160*b*, piston-cylinder devices 82*a* and 82*b* would be contracted to place first and second trough devices 24 and 24' in their operative positions in order to clamp off the lower end portions of sleeves 26 and 26' and place the trough portions 84 and 84' in vertical alignment with their associated platen elements 52 and 52' when in both their charging and pressing positions. As a practical matter, it would be preferable to continuously maintain trough devices 24 and 24' in their operative positions, except when required to be momentarily swung into their retracted positions to permit discharge of a "cake" of squeezed pulp from the press and/or replacement/-cleaning of the sleeves.

After placement of trough devices 24 and 24' in their operative positions and creation of charges of fruit to be pressed, piston-cylinder devices 160*a* and 160*b* are extended to permit the charges to flow from hoppers 134 and 134' downwardly through ducts 146 and 146' and into sleeves 26 and 26'. Thereafter, hoppers 134 and 134' are returned to their initial measuring positions to permit filling thereof with the next charges of fruit to be pressed, and piston-cylinder devices 116 contracted to move valve plates 110 and 110' into their clamping positions for purposes of clamping off the upper end of sleeve devices 26 and 26' in order to prevent "back-flow" of pulp during subsequent pressing thereof. Thereafter, piston-cylinder devices 78 are slowly contracted to move platen elements 52 and 52' towards associated platen elements 40 and 40' in order to compress the charges of fruit confined by sleeves 26 and 26' intermediate the upper and lower "clamp-off points" defined by valve plates 110, 110' cooperating with cover 44 and edges 90*a*, 90*a'*, cooperating with recesses 46 and 46', respectively. Juice extracted from the fruit, as a result of pressing thereof, flows through the compressed side surfaces of sleeves 26 and 26' and then downwardly either through slots 42 and 42' for collection in stationary trough 22 or through slots 54 and 54' for collection in trough portions 84 and 84', respectively. Trough portions 84 and 84' also serve to collect juice flowing directly through the unconstrained edges or dripping from sleeves 26 and 26'. The speed of movement of platen elements 52 and 52' and the amount of pressure exerted thereby would preferably be consistent with conventional platen press practices, with a view towards extracting a maximum quantity of high quality juice.

At the completion of the pressing operation, piston-cylinder devices 78 are first quickly extended to return platen elements 52 and 52' to their initial positions in order to reduce the time required to perform a complete cycle of press operation, whereafter piston-cylinder devices 116 and 82*a*, 82*b* are extended to return valve plates 110, 110' and trough devices 24, 24' to the positions indicated in full line in FIGS. 1 and 3. This serves to "open-up" the previously constricted upper and lower end portions of sleeves 26 and 26', as well as intermediate portions thereof, and to place chute portions 100 and 100' in vertical alignment with the sleeves. Upon this occurrence, pulp previously compacted by pressure to assume relatively thin sheets or "cakes" tends to automatically separate from the inner surfaces of the sleeves and fall downwardly under the influence of gravity for discharge through the lower open ends of the sleeves for collection by suitable means, such as conveyor 14. After discharge of the cakes, piston-cylinder devices 82*a* and 82*b* are immediately retracted to return trough devices 24 and 24' to their positions shown in FIG. 8 for purposes of again clamping off the lower ends of sleeves 26 and 26' and permit initiation of a subsequent cycle of press operation.

Various alternative forms of the above described press construction are contemplated. As by way of example, a press adapted for a low volume installation may be provided with only a pair of relatively movable platen devices in association with a single sleeve. On the other hand, the capacity of the illustrated press may be doubled by providing additional pairs of platens and sleeves, wherein an additional platen and its associated additional sleeve would be movably supported between the stationary platen device and each of the previously described movable platens. It is also contemplated that the upper valve plates may be dispensed with in certain instances, such as by way of example, when the supply mechanism is disposed in immediate proximity to the platens thereby permitting its outlet control valve to perform a dual function. Moreover, the above described upper and lower valve mechanisms may, if desired, be mounted on the movable platens, rather than being independently mounted on the framework of the press.

The hydraulic and electrical control circuits required to provide for sequential operation of the above mentioned piston-cylinder devices and/or for sensing of the level of fruit deposited in hoppers 134 and 134' may be conventional in all respects and thus form no part of the present invention.

What is claimed is:

1. A press particularly adapted for use in extracting juice from fuit, said press comprising in combination:

a pair of vertically disposed press platens including a stationary platen and a movable platen supported for horizontal movement relative to said stationary platen between remote charging and adjacent pressing positions;

a vertically extending sleeve formed of filter cloth, said sleeve being arranged horizontally intermediate said platens and having open upper and lower ends;

means for depositing a charge of fruit to be pressed within said sleeve through said upper end;

means for selectively closing said sleeve adjacent said lower end;

means for selectively closing said sleeve adjacent said upper end, said means for closing said lower and upper ends of said sleeve cooperating to retain said charge of fruit within said sleeve during pressing thereof incident to movement of said platens into said adjacent pressing positions; and means for collecting juice extracted from said charge of fruit disposed within said sleeve incident to pressing thereof, said means for collecting juice including a stationary trough operably associated with said stationary platen and a movable trough operably associated with said movable platen, and said means for closing said sleeve adjacent said lower end includes a stationary clamping surface and a movable clamping edge carried by said movable trough and cooperating with said clamping surface to close said sleeve.

2. A press according to claim 1, wherein said movable trough is supported for pivotal movements between an operative position in which said clamping edge and stationary clamping surface cooperate to clamp off said sleeve and a retracted position wherein a cake of fruit pulp remaining within said sleeve after extraction of juice from said charge of fruit is free to fall under the influence of gravity downwardly through said open lower end, said movable trough being sized to underlie said movable platen, both in its remote charging and adjacent pressing positions while said movable trough is in said operative position.

3. A press according to claim 2, wherein said lower end of said sleeve is fixed to said movable trough and said upper end of said sleeve is fixed to said means for depositing fruit within said sleeve.

4. A press according to claim 1, wherein said means for depositing fruit within said sleeve includes an outer hopper having a discharge duct disposed in flow communication with said upper end of said sleeve and an inner measuring hopper having an outlet and being movably supported within said outer hopper between measuring and discharge positions, said outlet being blocked by said outer hopper when said inner hopper is in said measuring position and being disposed in flow communication with said discharge duct when said inner hopper is in said discharge position.

5. A press according to claim 4, wherein said sleeve is suspended from said discharge duct for vertical movement relative thereto.

6. A press according to claim 1, wherein said means for depositing fruit in said sleeve includes a hopper mechanism having a discharge duct disposed in flow communication with said upper end of said sleeve, said sleeve being suspended from said hopper mechanism by resilient means permitting vertical movements of said sleeve relative to said discharge duct, said means for closing said upper end of said sleeve is disposed vertically intermediate said discharge duct and said platens said movable trough includes a discharge chute portion attached to said lower end of said sleeve for maintaining same in open condition, said movable trough is mounted for movement between a retracted position in which said discharge chute portion and said lower end of said sleeve are disposed in vertical alignment with said discharge duct and an operative position wherein said sleeve is clamped off between said clamping edge and said clamping surface at a point disposed vertically intermediate said platens and said lower end of said sleeve.

7. A press according to claim 6, wherein said movable trough is mounted for pivotal movement between its retracted and operative positions and said movable trough is sized to underlie said movable platen both in its remote charging and adjacent pressing positions while said movable trough is in its operative position.

8. A press particularly adapted for use in extracting juice from fruit, said press comprising in combination:

a framework;

stationary platen means supported on said framework and having a pair of parallel, vertical extending and oppositely facing platen elements;

first and second movable platen means supported on said framework on opposite sides of said stationary platen means and having vertically disposed platen elements arranged one in facing relationship with each of said platen elements of said stationary platen means;

means to move said first and second platen elements relative to said stationary platen means between remote charging and adjacent pressing positions;

a pair of sleeves formed of filter cloths and disposed to extend vertically one intermediate each of said first and second platen means and said stationary platen means, said sleeves having open upper and lower ends disposed relatively above and below the platen means, respectively;

supply means for depositing charges of fruit to be pressed in said sleeves through said upper ends thereof;

means for collecting juice extracted from said charge of fruit disposed within said sleeves incident to pressing thereof upon movement of said first and second platen means into said adjacent pressing positions, said means for collecting juice including a stationary trough disposed below and in operable association with said stationary platen means, a pair of movable troughs disposed below and in operable association one with each of said first and second platen means, said stationary trough defining a pair of oppositely facing clamping surfaces, said movable troughs each defining a clamping edge, and means for moving said movable troughs between operative positions in which their associated clamping edges cooperate with said stationary clamping surfaces to clamp off said sleeves vertically intermediate said platen means and said lower ends of said sleeves and retracted positions in which cakes of fruit pulp remaining within said sleeves after extraction of juice from said charges of fruit are free to fall under the influence of gravity downwardly through said open lower ends; and upper valve means for selectively clamping off said sleeves at points disposed vertically intermediate said platen means and said open upper ends.

9. A press according to claim 8, wherein said movable troughs are supported on said framework for pivotal movement between said operative and retracted positions, said movable troughs each mounting a discharge chute portion attached to the lower end of its associated sleeve for retaining same in open condition.

10. A press according to claim 8 or 9, wherein said supply means includes a pair of outer hoppers having discharge ducts communicating with said upper ends of said sleeves and a pair of measuring hoppers disposed one within each of said outer hoppers, said measuring hoppers having outlets and being supported for movement between measuring and discharge positions, said outlets being blocked by their associated outer hoppers when said inner hoppers are in their measuring positions and being disposed in flow communication with said discharge ducts of their associated outer hoppers when said inner hoppers are in their discharge positions.

11. A press particularly adapted for use in extracting juice from fruit, said press comprising in combination:

a vertically extending sleeve of filter cloth having an open upper end for receiving a charge of fruit to be pressed and an open lower end for discharging fruit pulp remaining in said sleeve after extraction of juice from said charge of fruit by compressing said sleeve;

a pair of vertically disposed press platens supported adjacent opposite sides of said sleeve for relative movement horizontally between remote sleeve charging and adjacent sleeve compressing positions for compressing said sleeve and said charge of fruit to effect extraction of juice therefrom;

means for maintaining said upper end of said sleeve in an open condition;

means for maintaining said lower end of said sleeve in an open condition;

means for introducing said charge of fruit into said sleeve into said upper end;

means for selectively closing off said sleeve intermediate said platens and said upper end;

means for selectively closing off said sleeve intermediate said platens and said lower end, the first and second said means for closing off said sleeve cooperating to retain said charge of fruit to be pressed within said sleeve during compression thereof; and (a pair of vertically disposed press platens supported adjacent opposite sides of said sleeve for relative movement horizontally between remote sleeve charging and adjacent sleeve compressing positions said sleeve and said charge of fruit to effect extraction of juice therefrom,)

means for collecting juice extracted from said charge of fruit incident to movement of said press platens between said remote and adjacent positions.

12. A press according to claim 11, wherein said means for collecting juice includes a pair of juice collecting troughs relatively movable between remote retracted and adjacent operative positions, said troughs being operatively associated one with each of said press platens, said means for closing off said sleeve intermediate said platens and said lower end includes clamping means associated with said troughs, and said clamping means is operable for closing off said sleeve when said troughs are in their operative position.

13. A press according to claim 12, wherein said press platens include a stationary platen and a movable platen, said troughs include a stationary trough operably associated with said stationary platen and a movable trough operably associated with said movable platen, and said movable trough is supported for pivotal movements between said retracted and operative positions.

14. A press according to claim 13, wherein said press includes an additional movable press platen, an additional sleeve disposed intermediate said additional press platen and said stationary platen, and an additional movable trough, said means for closing of said sleeve intermediate said platens and said lower end includes a pair of oppositely facing clamping surfaces defined by said stationary trough and a pair of clamping edges defined one by each of said movable and additional movable troughs, said clamping edges cooperating with said clamping surfaces to close off the sleeves when the movable troughs are pivoted into their operative positions.

15. The improvement according to claim 11, wherein said means for introducing said charge of fruit includes a hopper having a depending duct telescopically received within said upper end of said sleeve, and said sleeve is suspended beneath said hopper by resilient means permitting vertical movements of said sleeve relative to said hopper.

16. The improvement according to claim 11 or 15, wherein said press platens include a stationary platen and a movable platen, said means for collecting juice includes a stationary trough operably associated with and arranged beneath said stationary platen and a movable trough operably associated with and arranged beneath said movable platen, said movable trough is supported for pivotal movement relative to said stationary trough between retracted and operative positions and carries said means for maintaining said lower end of said sleeve in an open condition, said means for closing off said sleeve intermediate said platens and said lower end includes a clamping surface defined by said stationary trough and a clamping edge defined by said movable trough, said clamping edge cooperating with said clamping surface to close off said sleeve when said movable trough is in said operative position, and said clamping edge being spaced from said clamping surface when said movable trough is in said retracted position sufficiently to permit a cake of said fruit pulp remaining in said sleeve after extraction of juice from said charge of fruit to freely fall under the influence of gravity downwardly through said lower end.

17. The improvement according to claim 11, wherein said means for introducing said charge of fruit includes a hopper having a depending duct received within said upper end of said sleeve, said means for maintaining said upper end of said sleeve in open condition is supported by resilient means for permitting vertical movements of said upper end relative to said trough, said means for collecting juice includes a pair of troughs operably associated one with each of said platens, one of said troughs mounting said means for maintaining said lower end of said sleeve in open condition, said troughs cooperating to define said means for selectively closing off said sleeve intermediate said platens and said lower end of said sleeve, and said troughs being relatively movable between adjacent operative positions wherein they cooperate to close off said sleeve adjacent said lower end thereof and retracted positions wherein they are spaced to permit a cake of said fruit pulp remaining in said sleeve after extracting of juice from said charge of fruit to freely fall under the influence of gravity downwardly through said lower end.

18. A press according to claim 3, wherein said means for depositing fruit within said sleeve includes a hopper having a discharge duct telescopically received within said upper end of said sleeve, and the upper end of said sleeve is fixed to said hopper by resilient means permitting vertical movement of said sleeve relative to said duct.

* * * * *

UNITED STATES PATENT AND TRADEMARK OFFICE

CERTIFICATE OF CORRECTION

PATENT NO. : 4,303,011

DATED : December 1, 1981

INVENTOR(S) : Ralph E. Reiner

It is certified that error appears in the above-identified patent and that said Letters Patent are hereby corrected as shown below:

Col. 5, line 57 - Before "channels", please insert --- guide ---.

Col. 8, line 18 - "fuit" should be --- fruit ---.

Col. 10, Claim 11, lines 63 through 68 - Please delete "(a pair ...juice therefrom,)".

Signed and Sealed this

Sixth Day of April 1982

[SEAL]

Attest:

GERALD J. MOSSINGHOFF

Attesting Officer

Commissioner of Patents and Trademarks